United States Patent [19]

McLeod

[11] Patent Number: 4,600,091

[45] Date of Patent: Jul. 15, 1986

[54] CARRYALL HANDBAG AND MAT AND METHOD OF MAKING SAME

[76] Inventor: Shirley McLeod, c/o Country Collectibles, 289 Danbury Rd., Wilton, Conn. 06897

[21] Appl. No.: 713,316

[22] Filed: Mar. 18, 1985

[51] Int. Cl.[4] ..... A47C 17/82; B31B 21/26; B31B 21/60; B31B 21/74

[52] U.S. Cl. ..... 190/2; 190/115; 5/417; 383/4; 383/6; 493/226; 493/254; 493/916; 493/926

[58] Field of Search ..... 383/4, 22, 24, 6, 17; 224/156; 190/1, 2, 115; 5/417, 419; 493/226, 243, 244, 254, 267, 916, 926

[56] References Cited

U.S. PATENT DOCUMENTS

| | | | |
|---|---|---|---|
| D. 261,464 | 10/1981 | Smith | 5/419 X |
| 2,264,471 | 12/1941 | Glenn | 5/419 |
| 2,557,280 | 6/1951 | Hahn | 383/4 X |
| 2,783,473 | 3/1957 | Humpeler | 5/417 X |
| 2,898,609 | 8/1959 | Storie | 5/419 |
| 3,176,315 | 4/1965 | Freund | 5/417 X |
| 3,737,013 | 6/1973 | Powell | 206/287.1 |
| 4,273,380 | 6/1981 | Silvestri | 5/417 X |
| 4,516,668 | 5/1985 | Grayek | 383/4 X |

*Primary Examiner*—William Price
*Assistant Examiner*—Sue A. Weaver
*Attorney, Agent, or Firm*—Arthur T. Fattibene

[57] ABSTRACT

A carryall handbag and mat formed of a single blank of foldable sheet material, one end being reversely folded onto an intermediate portion of the blank to define a reversely folded portion and an extended portion. A plurality of seams secures the reversely folded portion to define a pocket. In one form of the invention, an endless handle is connected to one edge of the folded blank, over which the blank, when folded, can be draped to define a handbag, and which blank can be readily unfolded to define a mat. In another form, the blank is folded so that the defined pocket can be turned inside out with the extended portion being disposed folded within the pocket.

8 Claims, 14 Drawing Figures

FIG. 9
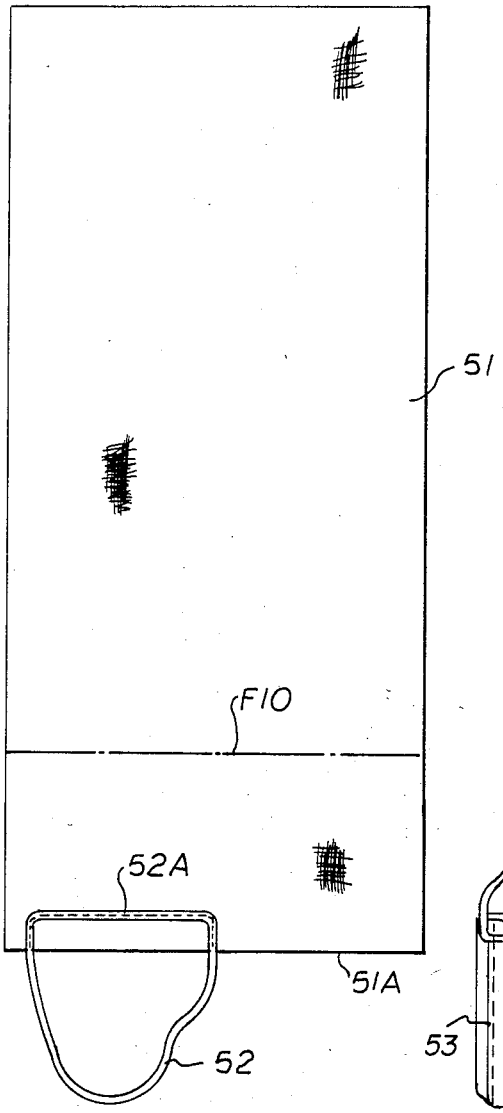
FIG. 10
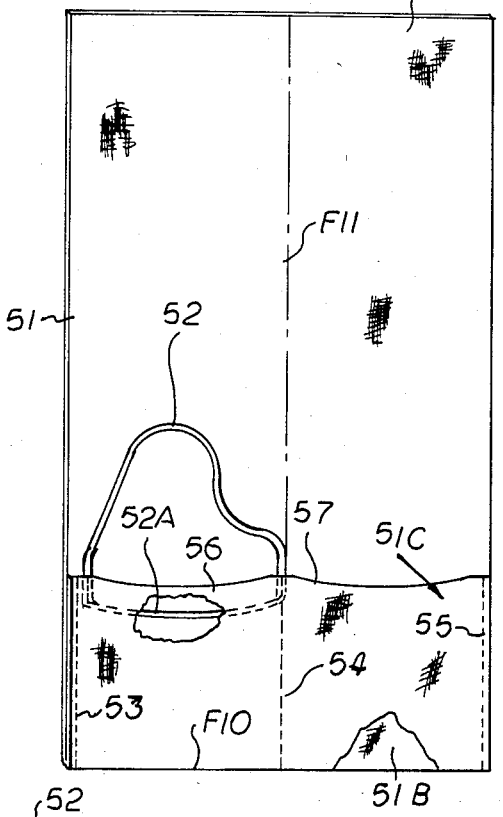
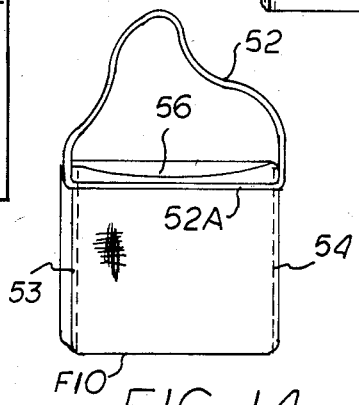
FIG. 14
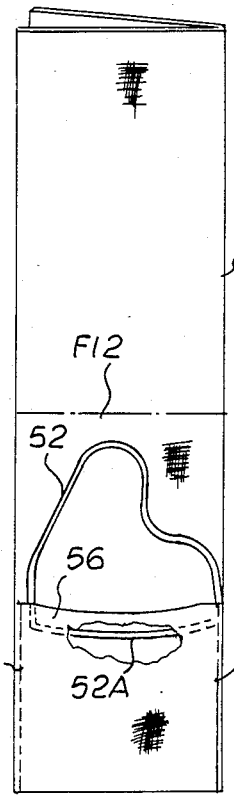
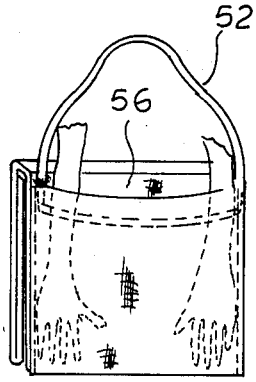
FIG. 13
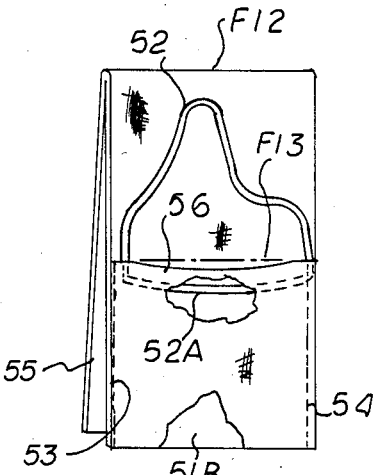
FIG. 12
FIG. 11

CARRYALL HANDBAG AND MAT AND METHOD OF MAKING SAME

This invention is directed to a combination handbag and mat which is formed from a single blank of foldable material which, in a folded position, defines a carryall handbag, and in the unfolded position, extended to a full length mat. More specifically, it is directed to improvements in combination handbag and mat of the type disclosed in U.S. application Ser. No. 06/546,278 filed Oct. 28, 1983, entitled Knock-Down Combination Handbag and Mat and Method of Making Same, now U.S. Pat. No. 4,516,668.

PRIOR ART AND PURPOSE

The U.S. patent application above cited, now U.S. Pat. No. 4,516,668; and the art cited therein, are known. In contrast thereto, the present invention is specifically directed to improvements thereover and more specifically to a greatly simplified structure to minimize costs of fabrication while at the same time improving the manner by which the blank forming the article can be folded between a folded handbag use and its expanded mat use.

OBJECT

An object of this invention is to provide a combination handbag and mat formed of a single blank of sheet material, which is partially formed so that it can be readily folded to define a carryall handbag and unfolded to define a full length mat.

Another object is to provide a combination handbag and mat having a handle loop arranged to function as a handle and support for the blank in the folded position thereof.

Another object is to provide a new article of manufacture which is relatively simple and inexpensive to fabricate, easy to use and positive in operation.

Another object is to provide an improved combination handbag and mat which can be readily folded into a compact form which can be readily carried in the folded position.

SUMMARY OF THE INVENTION

The foregoing objects and other features and advantages can be readily attained by a blank of foldable material sized to define a full length mat and which can be readily folded to define a carryall type handbag. The combination handbag and mat is formed by reversely folding an end portion of the blank onto an intermediate portion of the blank to define a doubled over portion and an extended portion. A plurality of spaced apart seams extending in a longitudinal direction secures the doubled over portion to define one or more open end pockets. In one form of the invention, an elongated cord is secured to the blank by one of the seams. The free ends of the cord are secured or tied to form an endless loop. The blank so formed is readily folded longitudinally and then transversely one or more times to reduce the size and shape of the blank to the size and shape of the pocket. The handle or loop is diposed between the final folds of the blank to support the same and define a handle for the folded blank to form a handbag in the folded position.

In another form of the invention, a cord defining the handle is secured to the blank adjacent one end, which end is then reversely folded onto an intermediate portion to define a double folded portion and an extended portion. The reversely folded portions are seamed together to define a pocket, and the blank is longitudinally and then transversely folded to compact the extended portion to the size and shape of the defined pocket. The pocket is then turned inside out to form the handbag whereby the extended portion is folded within the pocket.

FEATURES

A feature of this invention resides in a combination handbag and mat formed of a single blank of sheet material that is provided with an endless loop for supporting the blank in a compact folded position while functioning as a handbag.

Another feature resides in a combination handbag and mat having a handle uniquely connected thereto to facilitate carrying the handbag in the folded position of the blank.

Another feature resides in a combination handbag and mat which can be readily folded into a compact form so as to function as a handbag in the folded position and having an endless handle means for facilitating the carrying of the blank in the folded position.

Other features and advantages will become readily apparent when considered in view of the drawings in which:

FIG. 9 is a plan view of a blank for defining a modified embodiment.

FIG. 10 is a plan view of the blank illustrating an intermediate construction.

FIG. 11 is a perspective view of FIG. 10 illustrated in an intermediate folded position.

FIG. 12 is a perspective view of the blank of FIGS. 10 and 11 shown in a folded intermediate position.

FIG. 13 illustrates the modified embodiment of FIGS. 10 and 11 in another intermediate position.

FIG. 14 illustrates the embodiment of FIGS. 10 to 13 in the finally folded handbag position.

DETAILED DESCRIPTION

Figure 1:
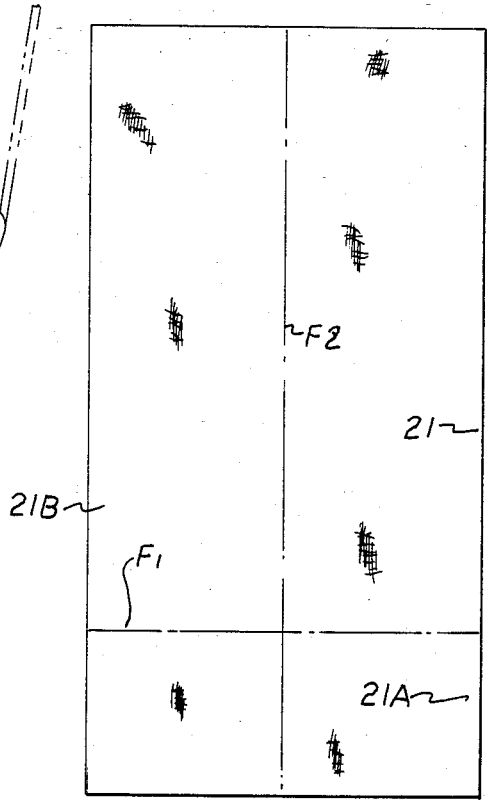
FIG. 1 is a plan view of a blank of sheet material from which the combination handbag and mat is formed.

Referring to the drawings, FIGS. 1 to 7 illustrate one embodiment of the invention. FIG. 1 illustrates a blank 21 of foldable sheet material from which the combination handbag and mat 20 is formed. The blank 21 may be formed of any suitable type material, for example a terrycloth or towel type material, a blanket type material and the like. Preferably the blank 21 is rectangular in shape and sufficiently large to define a mat upon which one may comfortably lie. A convenient blank size for use by an average adult may comprise a sheet approximately 6 to 7 feet long and 30 to 54 inches wide. However, it will be understood that the size of the sheet 21 may vary, depending upon its intended use; e.g. adult, child or infant.

To form the blank 21 so that it may form a handbag in the folded position and a mat in the extended position, an end portion 21A of the blank 21 is reversely folded about foldline $F_1$ onto an intermediate portion 21B of the blank 21 to define a doubled over portion A and an extended portion B.

Figure 2:
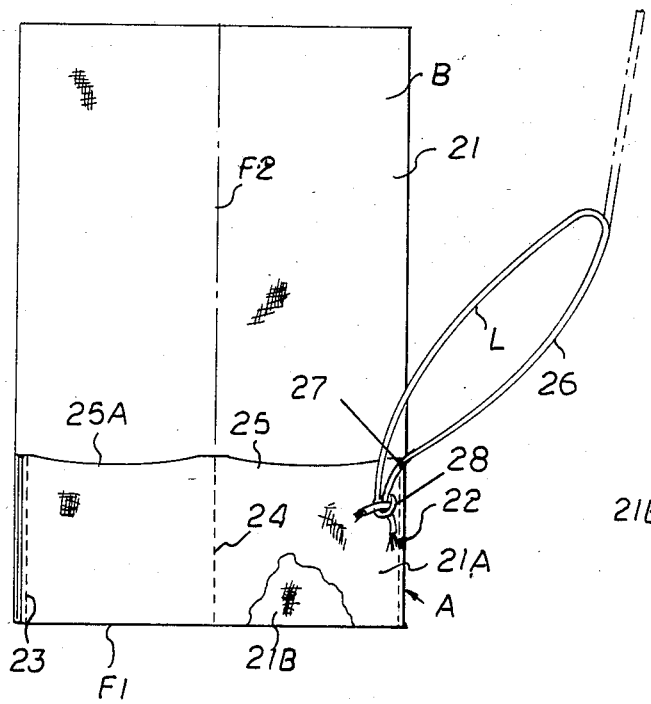
FIG. 2 is an intermediate plan view illustrating the invention used as a mat.

As shown in FIG. 2, the reversely folded end portion 21A is secured to the intermediate portion 21B by a plurality of seams, which may be sewn or otherwise secured. In the illustrated embodiment, a seam 22 and 23 extends longitudinally of the blank to secure the opposed ends of the doubled over portion A together. An intermediate seam 24 disposed between 22 and 23 may be made to define the doubled over portion into at least two open end pockets 25 and 25A.

In accordance with this invention, a handle means in the form of an elongated cord 26 is secured to the defined pocket. As shown in FIG. 2, the cord 26 is secured to the defined pocket by the seam 22 as indicated at 27. With the construction disclosed, it will be apparent that the cord 26 may be secured to the pocket at 25 during the forming of seam 22. Thus, by a single operation, the adjacent ends of pocket 25 and the handle cord are secured by seam 22. The opposed ends of the cord are secured to form an endless loop L (shown in solid line), e.g. by a knot 28 or by other suitable means.

With the blank construction thus described and shown in FIG. 2, the blank 21 can be readily formed into a carryall handbag by simply folding the blank in a predetermined sequence.

Figure 3:
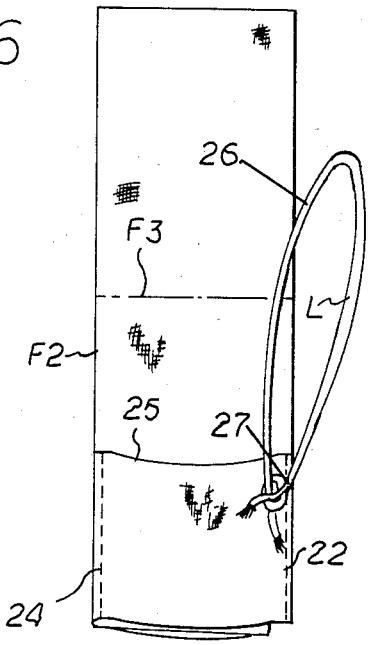
FIG. 3 is a plan view illustrating an intermediate step in folding the blank to form the handbag.

To form the blank 21 as shown in FIG. 2 to form the handbag, the blank of FIG. 2 is reversely folded in half along a longitudinally extending foldline $F_2$. As shown in FIG. 3, the formed blank of FIG. 2 is folded along foldline $F_2$ so that the pockets 25 and 25A are disposed on the exterior side of the fold.

Figure 7:
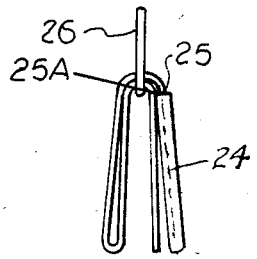
FIG. 7 is an end view of FIG. 6.
Figure 6:
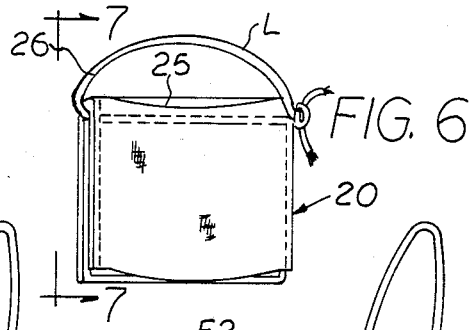
FIG. 6 is a view of the blank finally folded to define the handbag.
Figure 5:
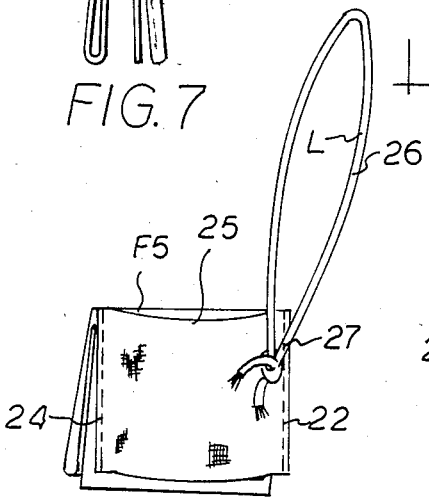
FIG. 5 is a plan view of the blank illustrated in a final folded position.
Figure 4:
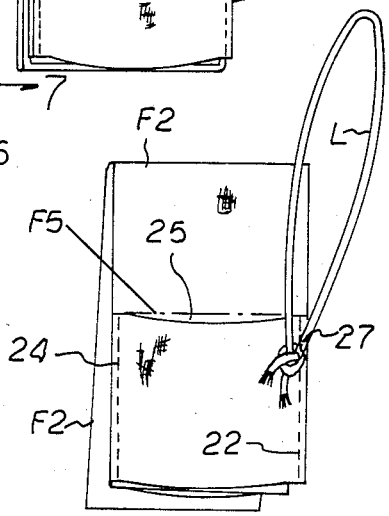
FIG. 4 is a perspective view of the blank in another intermediate folded position.

The folded blank of FIG. 3 is then reversely folded transversely in half along a foldline $F_3$ to a position shown in FIG. 4. The folded blank as shown in FIG. 4 is reversely folded about a second transverse foldline $F_5$ to a form as shown in FIG. 5. In this finally folded position, the extended portion B of the blank has been reduced to essentially the size and shape of the defined pocket 25 or 25A. In this position, it will be noted that the handle loop L is disposed adjacent one end of the pocket 25. In accordance with this invention, the handle loop L is looped between the final fold as shown in FIGS. 6 to 7 so that the folds disposed to either side of foldline $F_5$ are draped over a portion of the loop handle L and is supported thereby and defines a carrying handle for the bag thus formed. It will be understood that the loop L may be sufficiently large to define a shoulder type carrier or may be shortened to define a hand carrier type loop. FIGS. 6 and 7 illustrate the manner in which the handle or loop L is disposed between the final folds to provide a means for carrying the handbag thus formed in the folded position.

To convert the handbag into the extended mat, the blank is simply unfolded in the reverse manner to the mat position shown in FIG. 2. In the folded position as seen in FIG. 6, it will be noted that the pocket 25 is exteriorly disposed to provide the means by which various articles can be stored and/or carried. Pocket 25A to the inside of the fold defines a hidden or "secret" pocket.

Figure 8:
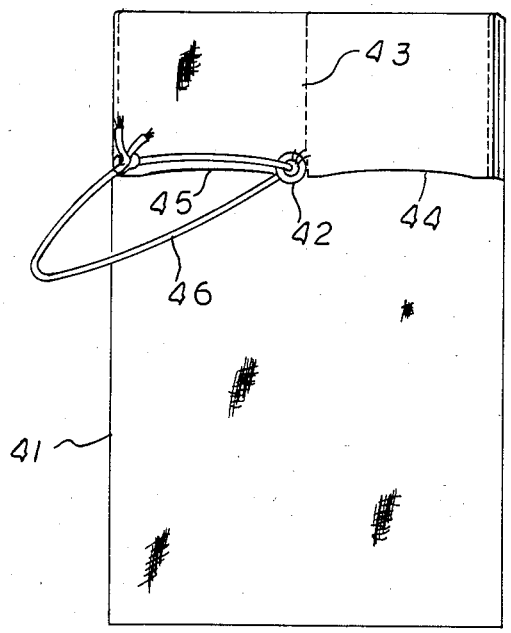
FIG. 8 is a plan view of a modified embodiment.

FIG. 8 illustrates a modified embodiment of the invention. In this form of the invention, the blank 41 is constructed as described with respect to FIGS. 1 to 7 with the exception that a ring or loop 42 is secured to or adjacent the central seam 43 which defines the pockets 44, 45. In this form of the invention, the free end of the handle cord 46 is threaded through the ring or loop 42 before the ends are tied or otherwise secured. Thus, in this form of the invention, the handle or cord is supported to opposed ends as a defined pocket, e.g. pocket 45. In all other respects, the blank 41 is folded as described with respect to FIGS. 1 to 7 to form the bag in the folded position of the blank.

FIGS. 9 to 14 illustrate another modified embodiment. In this form of the invention, the blank 51 is similar to that hereinbefore described. As shown in FIG. 9, an endless loop 52, to define a handle or shoulder strap for carrying the bag in the folded position of the blank, is secured to one end of the blank 51. This is accomplished by securing the handle 52 along a length thereof, which extends across the width of the blank along a distance equal to approximately half the width of the blank 51. The secured portion 52A extends generally parallel to the edge 51A of the blank 51.

With the handle 52 secured to the blank 51, the end of the blank 51A is reversely folded onto an intermediate portion of the blank as shown in FIG. 10 about a transverse foldline $F_{10}$. In this folded position of the blank 51, the reversely folded portion is secured to an intermediate portion 51B of the blank by a plurality of seams 53, 54 and 55 in a manner similar to that hereinbefore described to define at least a pair of open end pockets 56 and 57. In this formed position, the portion 52A of the handle or cord 52 is disposed between the folded end of the blank 51 and the intermediate underlying portion 51B as viewed in FIG. 10.

In the folded position of the blank 51 as shown in FIG. 10, the blank defines a doubled over or reversely folded portion 51C that defines the pockets 56 and 57 and as extended portion 51D. In this, the unfolded position of the assembled blank 51, the mat is defined. To assemble the blank into a handbag, the blank formed, as shown in FIG. 10, is first reversely folded in half about a longitudinally extending foldline $F_{11}$ to define a longitudinally disposed bi-fold as shown in FIG. 11. The longitudinal bi-fold is formed so that the open ended pockets 56 and 57 are externally positioned. In the bi-folded position of FIG. 11, the blank is folded one or more times in half about a transversely extending foldline to reduce the extended portion 51D of the blank to the size and shape of the formed pockets 56 or 57. For example, the bi-folded blank as shown in FIG. 11 is again folded in half about a first transverse foldline $F_{12}$ to form the blank as shown in FIG. 12. The blank as folded in FIG. 12 is again folded in half about a second transverse foldline $F_{13}$ to a position or form as shown in FIG. 13. In this final or last folded position, it will be noted that the extended portion 51D of the blank is compactly folded in a manner to be contiguously disposed to one side of pocket 56. To complete the formation of the folded blank 51 as herein described, the pocket portion 56 is folded inside out. This is attained by one extending his hands into the pocket 56 as shown in FIG. 13, grasping the opposed corners of the pocket and the folds of the extended portion 51D disposed contiguous and externally of the pocket 56, and turning the pocket 56 inside out. This manipulation results in the folds of the extended portion 51D being disposed within the pocket, when turned inside out, and the cord or handle portion 52A being disposed outside of the pocket 56 as shown in FIG. 14 to define the completed handbag in the finally folded position of the blank.

It will be apparent the finished handbag not only forms a container or carrier for retaining the extended portion 51D of the mat, but the pocket 56 is sufficiently large to carry other sundry items as may be desired. Thus, when the construction described herein is desired to be used as a beach bag, various beach type sundries can be carried in the pocket 56. At the beach, the handbag can be readily unfolded to define a beach blanket or mat, and the miscellaneous sundries can be placed in the pocket 56 or 57 when the construction is used as a mat as seen in FIG. 10.

The construction can also be used at sporting events or stadium type events as combination stadium blanket and handbag.

From the foregoing, it will be apparent that the construction is such that the combination handbag and mat can be simply and inexpensively formed by first making a simple reverse fold to define a doubled over portion and and securing the same by a plurality of simple straight seams; and by uniquely attaching the handle means thereto as defined herein to provide a carrying means for the handbag in the finally folded position, and which handle provides an adequate support for the assembled handbag. The arrangement is such that by simply bi-folding the blank first longitudinally, and then transversely one or more times, the extended portion of the sheet or blank is compacted to the size and shape of the finalized handbag simply and quickly; and is retained in said position either by looping the handle between the final fold or by turning the pocket inside out.

While the invention has been described with respect to several embodiments, it will be understood and appreciated that variations and modifications may be made without departing from the spirit or scope of the invention.

What is claimed is:

1. A combination handbag and mat comprising a blank of readily foldable sheet material having a predetermined length and width sized to define a mat in the unfolded position, said blank having an end portion reversely folded about a transverse foldline so as to be disposed contiguous an intermediate portion of said blank to define a doubled over portion and an extended portion, a plurality of seams securing said reversely folded portion to said contiguous intermediate portion to define a pocket, a handle means connected to the defined pocket, said doubled over portion and extended portion being reversely folded in half along a longitudinal foldline, said folded half being folded in half again along a transverse foldline a first time, and folded in half again along a second transverse foldline, and said handle being looped between the folds defined by said second foldline to provide a carrying handle for said blank in the folded position.

2. A combination handbag and mat as defined in claim 1, wherein said handle means includes an elongated cord defining an endless loop, and one of said seams securing said cord to one side of said doubled over portion.

3. A combination handbag and mat as defined in claim 2 wherein said cord has opposed end portions, the ends of said cord being connected.

4. A combination handbag and mat as defined in claim 2 and including a loop secured to said pocket spaced from said seam securing said cord, said cord being threaded through said spaced loop.

5. A knockdown combination handbag and mat comprising a blank of foldable sheet material having a predetermined length and width, a handle means, said handle means including a cord secured to one end of said sheet, said cord extending contiguous to one edge of said blank and extending generally parallel said one edge of said blank, said cord extending transversely of said blank approximately half the width thereof, said one end of said blank being reversely folded onto an intermediate portion of said blank to define a reversely folded portion and an extended portion whereby said cord is disposed between said reversely folded end portion and said intermediate portion, a plurality of seams securing said one end portion to said intermediate portion, said seams extending longitudinally of said blank to define an open end pocket, said folded blank being reversely folded in half along a longitudinally extending foldline so that the said pocket is exteriorly disposed, said longitudinally folded blank being folded about a transverse foldline one or more times to reduce the extended portion to the size of said pocket, said pocket being turned inside-out with said folded extended portion disposed within said pocket, and said cord defining a handle for said handbag in the folded position of said blank.

6. A method for forming a knockdown combination handbag and mat from a blank of foldable sheet material having a predetermined length and width of a size to define a mat comprising the steps of reversely folding one end of said blank onto a contiguous portion of said blank, forming a plurality of spaced apart seams for securing said folded one end portion to said contiguous portion of said blank to define an open end pocket, attaching an elongated cord to one side of said pocket at one of said seams, said cord defining an endless loop, folding said blank in half along a longitudinal foldline to form a half folded blank, whereby the open end pocket is exteriorly disposed, and folding said half folded blank in half about a transverse fold line, and folding said folded blank again in half a second time about a transverse foldline, and looping said handle between the halves defined by said last mentioned fold.

7. A method of forming a combination handbag and mat from a blank of foldable sheet material comprising the steps of securing a cord to said blank of foldable material adjacent one end thereof whereby said cord extends transversely of said blank approximately half the width thereof, said cord extending generally parallel said one end, reversely folding said one end of said blank onto an intermediate portion of said blank to define a reversely folded portion and an extended portion, securing said reversely folded end to said intermediate portion by a plurality of spaced apart seams extending longitudinally of said blank, to define an open end pocket, reversely folding said blank in half along a longitudinally extending foldline, reversely folding said half folded blank about a transverse foldline, reversely folding said folded blank about a second transverse foldline whereby said blank is folded to the shape of said pocket, and reaching into said pocket and turning said pocket inside out so that the folded portion of said blank is disposed within said pocket to define a handbag.

8. The method as defined in claim 7 wherein the step of securing said one end of said blank to said intermediate portion includes a pair of end seams extending longitudinally adjacent the opposed longitudinal marginal edge of said blank and an intermediate seam disposed between said pair of seams to define a pair of side by side open end pockets.

* * * * *